US010060711B2

(12) United States Patent
Spooner et al.

(10) Patent No.: US 10,060,711 B2
(45) Date of Patent: Aug. 28, 2018

(54) THERMALLY EMISSIVE APPARATUS

(75) Inventors: Christopher Douglas James Spooner, Bracknell (GB); Greg Peter Wade Fixter, Hook (GB); Paul Barrie Adams, Aldershot (GB); Andrew Shaun Treen, Exeter (GB)

(73) Assignee: QINETIQ LIMITED (GB)

( * ) Notice: Subject to any disclaimer, the term of this patent is extended or adjusted under 35 U.S.C. 154(b) by 120 days.

(21) Appl. No.: 13/060,213

(22) PCT Filed: Aug. 26, 2009

(86) PCT No.: PCT/GB2009/002072

§ 371 (c)(1),
(2), (4) Date: Feb. 22, 2011

(87) PCT Pub. No.: WO2010/026364

PCT Pub. Date: Mar. 11, 2010

(65) Prior Publication Data

US 2011/0147369 A1 Jun. 23, 2011

(30) Foreign Application Priority Data

Sep. 8, 2008 (GB) ..... 0816376.8

(51) Int. Cl.

| | |
|---|---|
| ***H05B 3/10*** | (2006.01) |
| ***F41J 2/02*** | (2006.01) |
| ***H05B 3/26*** | (2006.01) |

(52) U.S. Cl.

CPC ..... *F41J 2/02* (2013.01); *H05B 3/26* (2013.01); *H05B 2203/011* (2013.01);
(Continued)

(58) Field of Classification Search

CPC ..... F41J 2/02; H05B 2203/011; H05B 2203/013; H05B 2203/017; H05B 2203/032; H05B 3/26
(Continued)

(56) References Cited

U.S. PATENT DOCUMENTS 3,735,137 A * 5/1973 Bly ..... 250/495.1
4,058,734 A * 11/1977 Vroombout ..... G01J 5/522 250/493.1
(Continued)

FOREIGN PATENT DOCUMENTS

WO WO 06/085054 8/2006
WO WO 08/033839 3/2008

*Primary Examiner* — Tu B Hoang
*Assistant Examiner* — Diallo I Duniver
(74) *Attorney, Agent, or Firm* — McDonnell Boehnen Hulbert & Berghoff LLP

(57) ABSTRACT

A thermally emissive apparatus (2) having an electro-thermal heating element (6) comprising a layer (8) of a first material having a first resistivity and a plurality of discrete regions (10) of a second material having a second resistivity substantially lower than that of the first material in electrical contact with the first material. The plurality of regions (10) of second material are arranged spatially so as to impart a predetermined effective sheet resistivity to the first layer (8). A plurality of heating elements may be used having a common first layer (30) of first material, wherein the spatial arrangement of the regions (10) of second material within a first heating element are optionally different to that within a second heating element. In this configuration the first and second heating elements may emit infrared radiation (14) having different intensities. The apparatus (2) finds applications as a thermal target and as an electro-thermal ice protection device.

15 Claims, 5 Drawing Sheets

(52) U.S. Cl.
CPC .. *H05B 2203/013* (2013.01); *H05B 2203/017* (2013.01); *H05B 2203/032* (2013.01)

(58) Field of Classification Search
USPC ..... 219/522, 528, 549, 552, 201; 273/348.1, 273/348, 371; 250/495.1, 493.1, 504 R
See application file for complete search history.

(56) References Cited

U.S. PATENT DOCUMENTS

| | | | | | |
|---|---|---|---|---|---|
| 4,240,212 | A | * | 12/1980 | Marshall et al. | 273/348.1 |
| 4,546,983 | A | * | 10/1985 | Rosa | 273/348.1 |
| 4,659,089 | A | * | 4/1987 | Rosa | 273/348.1 |
| 4,706,251 | A | * | 11/1987 | Rona | H01S 5/026 257/289 |
| 4,792,142 | A | * | 12/1988 | Davies | 273/348.1 |
| 4,946,171 | A | | 8/1990 | Merle et al. | |
| 5,065,032 | A | * | 11/1991 | Prosser | 250/495.1 |
| 5,066,019 | A | | 11/1991 | Dean et al. | |
| 5,296,270 | A | * | 3/1994 | Prosser | 427/448 |
| 6,180,929 | B1 | * | 1/2001 | Pearce | 219/528 |
| 6,531,859 | B1 | | 3/2003 | Bischoff | |
| 2004/0025342 | A1 | * | 2/2004 | Morris | B06B 1/0607 29/890.1 |
| 2008/0296842 | A1 | * | 12/2008 | Novak et al. | 273/348.1 |

* cited by examiner

THERMALLY EMISSIVE APPARATUS

FIELD OF THE INVENTION

The present invention relates to a thermally emissive apparatus. The invention relates specifically, but not exclusively, to a thermally emissive apparatus for use as a thermal infrared target and to a method of simulating the thermal appearance of an object. Without limitation, the invention also relates to a thermally emissive apparatus for use as an electro-thermal heater.

BACKGROUND OF THE INVENTION

By way of background to the present invention, all surfaces above absolute zero emit infrared (IR) radiation into their surroundings. The surface IR emissions from an object result in a detectable contrast and hence the object will have a characteristic thermal image, termed its thermal signature. This phenomenon has found widespread use in military applications such as thermally targeted weaponry and imaging systems for use as soldier aids (night vision goggles (NVG)), and in civil applications such as surveillance of the thermal appearance of industrial processes and equipment in order to recognise deficiencies and hazards. Accordingly, there is a need to simulate thermal signatures of objects using thermal targets in order to train personnel in object recognition and assessment. Said thermal targets must be capable of presenting the correct thermal signature when viewed through equipment such as night vision goggles, IR weapon sights or thermal imaging cameras.

An effective way of providing a thermal signature of an object is to use an electrically heated thermal target. By way of example, U.S. Pat. No. 4,546,983, U.S. Pat. No. 4,659,089, U.S. Pat. No. 4,792,142, and U.S. Pat. No. 5,066,019 describe a variety of conventional electrically heated thermal targets.

It is desirable that the infrared radiation emitted by a thermal target correspond closely with that characteristically emitted by the object being simulated in respect of both the intensity and spatial pattern of the emitted infrared radiation. Typically, the thermal signature of an object is composed of a number of key elements, known as thermal signature cues. Said thermal signature cues enable trained personnel to detect objects from thermal images thereof and to ascertain information about the object under surveillance. Hence, faithfully recreating the thermal signature of an object may require a thermal target having many individual elements of different aspect ratios, sizes and surface temperatures acting as a whole.

The characteristics of the infrared radiation emitted by an electrically heated thermal target are traditionally determined by the thermal and electrical characteristics of the target, which are in turn dependent upon its construction. Electrically heated thermal targets operate by passing an electrical current through resistive heating elements therewithin to cause Joulean heating. The heated elements in turn give rise to emission of thermal infrared radiation from surface of the target. The production of heat within the target is a function of the current (and therefore the applied voltage) and the resistivity of the material of which the heating elements are comprised, the latter being dependent on the composition of the resistive material from which the heating element is fabricated and the width and thickness thereof. The amount of IR energy radiated from the heated surface of the target, compared to that expected from its physical temperature, is determined by the emissivity of the surface. The emissivity is generally low for metals and high for polymer materials.

A conventional thermal target may comprise elements which can be modified in a number of ways so as to emit thermal signature cues having desired characteristics.

For example, in U.S. Pat. No. 4,546,983 the intensity of infrared radiation emitted by heating elements within the target may be altered by varying the input voltage to heating elements within the target, or increasing/decreasing the thickness of the electrically resistive layer (thereby modifying the current passing through said heating element). Alternatively, or in addition, the resistivity of the electrically resistive layer may be varied by altering the composition of the resistive layer. In practice, this may be done using mixtures of materials with different bulk resistance.

Another method described in U.S. Pat. No. 4,546,983 for altering the intensity of emitted infrared radiation comprises perforating the resistive layer so as to decrease the area available to generate thermal infrared radiation. The reduction in the intensity of emitted infrared radiation is proportional to the area of the perforations and not due to electro-thermal effects (the current density in the remaining portions of the resistive layer remains unchanged).

Notwithstanding the efficacy of the abovementioned techniques, traditional methods of varying the infrared radiation emitted by a thermal target are difficult to implement during manufacturing and are therefore expensive.

Accordingly, it is an object of the invention to provide a thermally emissive apparatus which mitigates at least some of the disadvantages of the conventional devices described above.

SUMMARY OF THE INVENTION

According to a first aspect of the present invention, there is now proposed a thermally emissive apparatus having at least one electro-thermal heating element, said heating element comprising a first layer of a first material having a first resistivity and a plurality of discrete regions of a second material in electrical contact with the first material, wherein the second material has a second resistivity substantially lower than that of the first material.

In a preferred embodiment, said plurality of regions of second material have a spatial arrangement which cooperates with the first layer so as to modify the sheet resistivity of the first layer in the vicinity of said spatial arrangement. In this embodiment, the plurality of regions of second material have a spatial arrangement which cooperates with the first layer so as to impart a predetermined effective sheet resistivity to the first layer in the vicinity of said spatial arrangement. For the avoidance of doubt, the effective sheet resistivity of the first layer is a measure of the sheet resistivity of said layer as modified by the plurality of regions of second material in electrical contact therewith.

In the interests of clarity, the plurality of discrete regions of second material are arranged in spaced relationship to one another within said spatial arrangement. Conveniently, the first layer of first material and the plurality of discrete regions of second material are disposed on a substrate.

The present thermally emissive apparatus is beneficial in that the sheet resistivity of the first layer of the heating element is easily modified by the spatial arrangement of the regions of second material.

As described above, faithfully recreating the thermal signature of an object may require a thermal target having many individual elements of different aspect ratios, sizes and surface temperatures acting as a whole. To achieve the same surface temperature with elements having different aspect ratios, or different surface temperatures with the same aspect ratio under a common voltage, requires the heating elements to be fabricated with different surface resistances. This can be achieved by a number of well known methods, for example controlling the thickness of conductive coatings, but is conveniently done using mixtures of different resistive inks with different bulk resistance which are homogeneously mixed to create the required final bulk resistance.

Conventionally, the resistive materials are carbon based inks and the heating elements are fabricated by screen printing said inks into the desired shapes usually being electrically connected by suitably shaped bus bars present on the same substrate plane laid down by means of printing silver based inks or etching of a copper foil. Typically, each ink is deposited in a separate printing stage; accordingly a complex, high fidelity thermal target may require many different ink mixtures and subsequent deposition and drying cycles. It can be seen that achieving high fidelity thermal targets using conventional processes involves a large number of sequential processes, using bespoke material formulations for each element, which increases manufacturing costs and can result in low production yields.

In contrast, the structure of the present thermally emissive apparatus facilitates fabrication by eliminating the need for multiple ink formulations having different bulk resistivities, thereby reducing the requisite number of printing stages. In the present invention, processing steps can be minimised by merely varying the plurality of discrete regions of a second material in electrical contact with the first material. In this way manufacturing costs can be reduced and improved simulation of thermal signatures can be achieved.

The structure of the present thermally emissive apparatus provides an improved heating effect in comparison with conventional devices and enables the heating effect within the apparatus to be controlled over large areas. For example, the present thermally emissive apparatus benefits from lower power consumption than conventional apparatuses because the large surface area and planar nature of the present electro-thermal heating elements enables the heating elements to be operated at lower temperatures than conventional heating elements. Accordingly, the effective resistivity of the first layer is arranged so as to provide a higher resistance than that of conventional thermal targets.

The apparatus may also comprise a substantially insulating material to reduce unwanted thermal losses.

Mindful that the heating element within the apparatus comprises thin layers of materials, the apparatus exhibits a lower thermal mass than conventional devices. The thin layer construction also enables rapid heating across substantially the whole of the apparatus rather than having to rely on localised heating and thermal conduction as in conventional apparatuses. Thus, the apparatus heats quickly to its operating temperature when in use.

Although quick to heat to its operating temperature, the apparatus cools at a slower rate which provides an additional advantage in terms of maintaining the operating temperature once achieved. This difference in the heating and cooling rates allows the electric field (and hence current) to be applied to the apparatus intermittently whilst still maintaining the required operating temperature. Thus, the electric field may be applied to the apparatus in the form of a time varying waveform such as a regularly repeating waveform or as a series of pulses. The duty cycle of the of the waveform or the pulse train may be varied so as to maintain the desired operating temperature and reduce power consumption.

The low thermal mass of the apparatus derives at least in part from the low physical mass of the apparatus. When used in a thermal target, the low physical mass of the apparatus enables thermally emissive apparatuses to be printed on opposing sides of the target, thereby allowing rapid changes in target representations, e.g. switching of targets between representations of friend and foe.

The thin layer construction of the present thermally emissive apparatus offers flexibility of operational voltages, and facilitates low voltage operation.

The present apparatus also provides advantages in terms of improved physical robustness due to the plurality of regions of second material being distributed spatially over the surface of the first layer. In contrast, conventional thermally emissive apparatuses comprise fine wires which are vulnerable to damage.

The structure of the present thermally emissive apparatus also offers the potential to compensate for systematic variations in the manufacturing process, e.g. inconsistencies in ink thickness during screen printing.

By using a plurality of regions of second material, high resolution spatial patterns are feasible, allowing simulation of thermal signatures of objects at close range.

Without limitation, the spatial arrangement of the plurality of regions of second material relates to the size of said regions (the dimensions and hence the area thereof), the shape of the regions, and the magnitude of the spaces between said discrete regions (i.e. the pitch of said discrete regions within the spatial arrangement).

Accordingly, varying the spatial arrangement of the plurality of regions of second material gives different percentage area coverage of said second material and so different average sheet resistivities (and hence resistances) can be obtained using a single first layer of first material for a plurality of different heated shapes within a thermal target.

Thus, the average sheet resistance of the electro-thermal heating element can be varied in a controlled manner, which in turn provides control over the intensity of thermal infrared radiation emitted in the vicinity of said spatial arrangement. In this manner the intensity of the emitted thermal infrared radiation can be set at a predetermined level.

Advantageously, the plurality of regions of second material and the electrical contacts with the first material cooperate to reduce the sheet resistivity of the first layer below that of the first material.

Typically, first material is a substantially resistive material and the second material is a substantially conductive material, e.g. a metallic material. The first material may typically comprise a carbon based ink. The second material typically comprises ink incorporating metallic particles, for example a silver based ink. The second material may also be used to provide electrodes (electrical bus bars) for the at least one electro-thermal heating element, in which case the plurality of regions of second material may be printed in the same processing step as the electrodes.

Conveniently, the spatial arrangement of the regions of second material within the heating element is non-uniform such that the effective sheet resistivity of the first layer varies spatially in relation to the spatial arrangement of the regions of second material.

Advantageously, the size or shape of the space between adjacent regions of second material varies in at least one direction in a plane substantially parallel with first layer such that the resistivity of the first layer varies spatially in said at least one direction. Alternatively, or in addition, the size or shape of the regions of second material may vary in said at least one direction. In another embodiment, the size or shape of the space between adjacent regions of second material varies in a plurality of directions. Similarly, the size or shape of the regions of second material may vary in a plurality of different directions.

In a preferred embodiment, the spatial variation in effective sheet resistivity of the first layer is arranged so as to impart a substantially constant resistance to the first layer when measured at all positions of the heating element in all directions parallel with a direction of current flow therewithin.

For example, the first layer may have a substantially constant resistance when measured at the electrodes of the electro-thermal heating element. Typically, the predominant direction of current flow shall be between the electrodes of the heating element.

Preferably, the spatial variation in effective sheet resistivity of the first layer is arranged so as to provide a substantially uniform current density within the first layer during use. In this manner, the spatial variation in effective sheet resistivity of the first layer may be arranged so as to provide substantially uniform Joulean heating of the heating element during use.

In a preferred embodiment, the thermally emissive apparatus may be arranged in use to emit infrared radiation having an intensity which is substantially uniform spatially over a surface of the heating element.

This is particularly important for providing even heating of complex shapes, for example circles etc. Hitherto, electro-thermal heating elements having complex shapes (i.e. shapes other than simple rectilinear forms) have been avoided because the current flowing within complex shaped heating elements travels preferentially via routes which present the shortest distance and hence lowest path of resistance between opposing electrodes. If the surface resistance is uniform this non-uniform current distribution results in non-uniform current density within the heating element which gives a varying heat distribution across the surface of the heating element.

In this embodiment, the spatial arrangement of regions of second material cooperates with the complex shape of the heating element to provide a constant current density across the surface of the heating element. Accordingly, an even heat distribution is provided across the surface of the heating element and hence the intensity of thermal infrared radiation emitted from the heating element is constant across its surface.

The spatial arrangement of the regions of second material may comprise a pattern in which the spatial density of the regions of second material tapers across the surface of the first layer so as to compensate for changes in current density caused by variations in geometry and provide constant Joule heating over the entire surface area of the heating element.

In an alternative embodiment, the spatial variation in effective sheet resistivity of the first layer is arranged so as to provide a substantially non-uniform current density within the first layer during use. In this manner, the spatial variation in effective sheet resistivity of the first layer may be arranged so as to provide substantially non-uniform Joulean heating of the heating element during use.

Hence, the thermally emissive apparatus may be arranged in use to emit infrared radiation having an intensity which varies spatially over a surface of the heating element in relation to the spatial arrangement of the regions of second material. In this way a complex thermal image can be created using a single heating element.

The size or shape of the space between adjacent regions of second material may vary substantially linearly in at least one direction in a plane substantially parallel with first layer such that the resistivity of the first layer varies substantially linearly spatially in said at least one direction. Alternatively, or in addition, the size or shape of the regions of second material may vary substantially linearly in said at least one direction. In this embodiment, the spatial arrangement of the regions of second material is such that in use the thermally emissive apparatus emits infrared radiation having an intensity which varies substantially linearly in said at least one direction over a surface of the heating element.

In another embodiment, the size or shape of the space between adjacent regions of second material varies substantially linearly in a plurality of directions. Similarly, the size or shape of the regions of second material may vary substantially linearly in a plurality of directions. In this embodiment, the spatial arrangement of the regions of second material is such that in use the thermally emissive apparatus emits infrared radiation having an intensity which varies substantially linearly in a plurality of directions over a surface of the heating element.

In another preferred embodiment, the thermally emissive apparatus has a plurality of electro-thermal heating elements arranged spatially on a surface thereof, said plurality of heating elements having a common first layer of first material.

This facilitates fabrication of the thermally emissive apparatus because the first layer of first material may be provided for all heating elements in a single process step. For example, the first layer of first material may be continuous across all heating elements and provided as a single screen printed layer of electrically resistive ink. Alternatively, the first layer of first material may be discontinuous across the heating elements and provided as a single screen printed layer of electrically resistive ink.

Where the thermally emissive apparatus includes a plurality of electro-thermal heating elements, said plurality of heating elements may have at least one common electrical connection which may be provided by a layer of a third material.

Having a common electrical connection layer simplifies the construction of the thermally emissive apparatus and hence fabrication of the apparatus requires fewer processing steps. Preferably, the third material is a substantially conductive material, for example a conductive ink. The second and third materials may be the same, in which case the second and third materials may be applied in a single, common processing step. Where the second and third materials comprise a conductive ink, said processing step may comprise screen printing.

Where the thermally emissive apparatus includes a plurality of electro-thermal heating elements, the spatial arrangement of the regions of second material is preferably the same within said plurality of heating elements.

Alternatively, the spatial arrangement of the regions of second material within a first heating element may be different to that within a second heating element. In this case, the thermally emissive apparatus may be arranged in use to emit infrared radiation having a first intensity from the first heating element and to emit infrared radiation having a second intensity from the second heating element.

Preferably, the first and second intensities are different. This enables the simulation of thermal signatures having thermal signature cues of different temperatures. The different temperatures are denoted by said first and second heating elements emitting thermal infrared radiation having different intensities.

In a further preferred embodiment, the thermal emissivity of the regions of second material cooperates with the effective sheet resistivity of the first layer so as to vary the intensity of infrared radiation emitted by the thermally emissive apparatus.

Accordingly, a difference in the thermal emissivity between the first and second materials may be utilised to increase the thermal infra red intensity gradient across a heating element so as to give an additional difference in apparently temperature of up to 5° C.

Where the first and/or the second material exhibits a low thermal emissivity, the thermally emissive apparatus should preferably comprise an IR emissive surface having a high thermal emissivity in order to maximise heat output and therefore minimise electrical power consumption. Where the thermally emissive apparatus comprises a substrate, the IR emissive surface may comprise said substrate. In this case, the substrate should be orientated towards an observer, i.e. the thermally emissive apparatus should be viewed from the same side as the substrate. Alternatively, the IR emissive surface may comprise an additional layer of material having a high emissivity, for example an electrically insulating lacquer. In this case, the high emissivity surface may be provided by an additional printing process step.

In another embodiment, the thermally emissive apparatus may comprise at least one of a substantially insulating material and a substantially thermally reflective material to reduce unwanted thermal losses from the apparatus and therefore minimise electrical power consumption. Without limitation, the substantially insulating material may comprise a substantially insulating layer, e.g. a layer of foam insulation. The substantially thermally reflective layer may comprise a metallic reflector, e.g. a metallic foil disposed in a spaced arrangement with thermal heating element.

Preferably, the thermally emissive apparatus is adapted in use to emit thermal infrared radiation having a wavelength in the range 1 μm-100 μm, preferably 3 μm-14 μm, more preferably at least one of 3 μm-5 μm and 8 μm-14 μm.

According to a second aspect of the invention, there is now proposed a thermal target for simulating the thermal signature of an object comprising a thermally emissive apparatus according to the first aspect of the invention.

According to a third aspect of the invention, there is now proposed an electro-thermal ice protection device for providing ice protection of an aerodynamic surface comprising a thermally emissive apparatus according to the first aspect of the invention. In this way, the invention can be embodied in an aerodynamic surface, for example an aircraft aerofoil, comprising a thermally emissive apparatus according to the first aspect of the invention. Such an aerodynamic surface is advantageous in that it reduces or eliminates formation of ice thereon. Such an aerodynamic surface is also capable of de-icing itself without application of chemical de-icing agents.

In another aspect, the invention resides in the use of a thermally emissive apparatus according to the first aspect of the invention as a thermal target to simulate the thermal signature of an object.

In an alternative aspect, the invention resides in the use of a thermally emissive apparatus according to the first aspect of the invention as an electro-thermal ice protection device to provide ice protection of an aerodynamic surface.

In a further aspect, the invention relates to a method of simulating the thermal signature of an object.

DESCRIPTION OF THE DRAWINGS

The invention will now be described, by example only, with reference to the accompanying drawings in which;

FIG. 4*a* illustrates a conventional thermally emissive apparatus having a conventional circular electro-thermal heating element known in the art. FIG. 4*b* illustrates a thermally emissive apparatus having a circular electro-thermal heating element according to one embodiment of the present invention.

DESCRIPTION OF THE INVENTION

Figure 1:
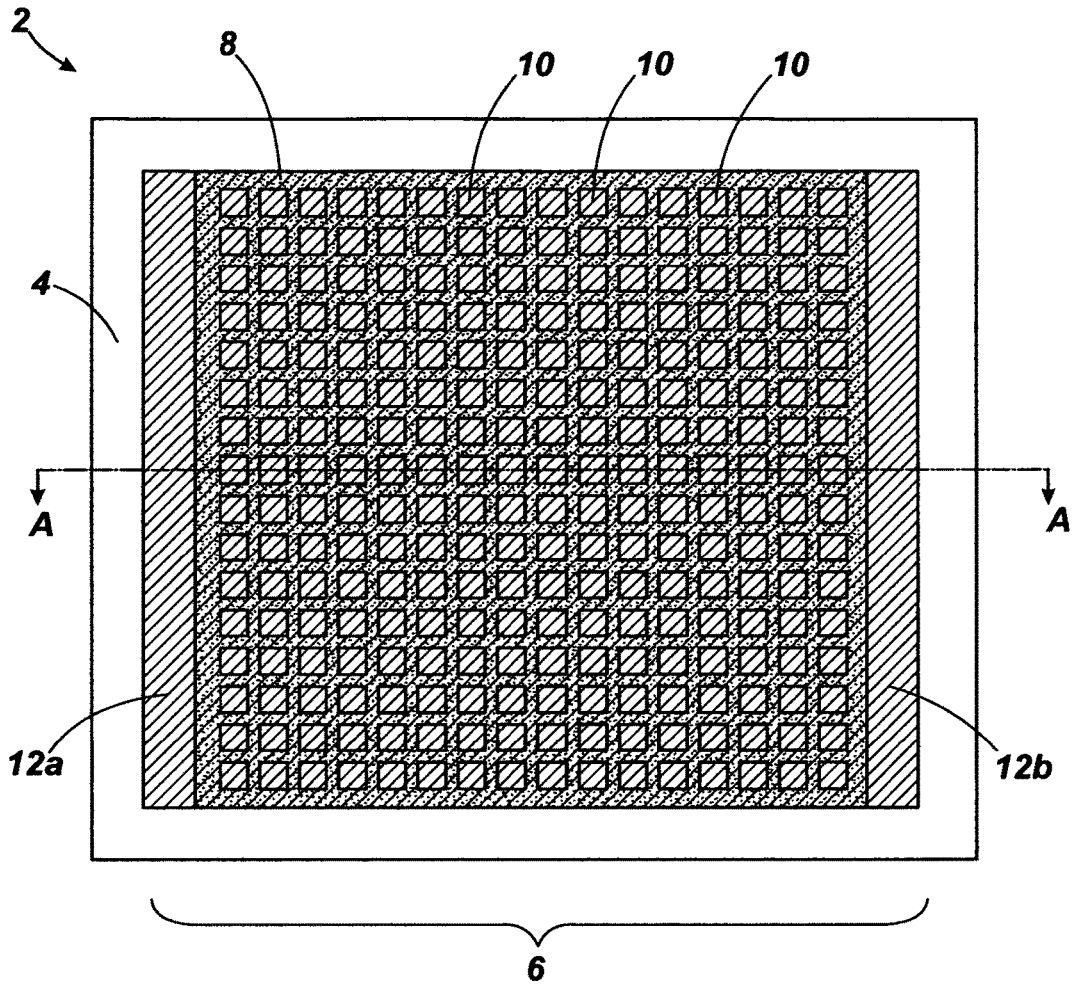
FIG. 1 shows a schematic view of a thermally emissive apparatus according to one embodiment of the present invention.

Referring now to FIG. 1, a thermally emissive apparatus 2 according to one embodiment of the present invention comprises a substrate 4 carrying an electro-thermal heating element 6 comprising a first layer 8 of a first substantially electrically resistive material having a plurality of discrete regions 10 of a second substantially electrically conductive material in electrical contact therewith. The thermally emissive apparatus also includes electrodes 12*a*, 12*b* for applying a uniform electric field to the electro-thermal heating element 6.

Although similar structures are known in the prior art (for example, see U.S. Patent Application US2004025342), said prior art structures have hitherto been used exclusively as acoustic transducers.

The first and second materials comprise thermoplastic inks and the apparatus is fabricated by screen printing the heating element 6 onto the substrate 4. Without limitation, the first material comprises a carbon based thermoplastic ink (for example Nicomatic NCC-500C) and the second material comprises a silver based ink (for example Acheson Electrodag PF410). The carbon based ink is screen printed onto the substrate 4 and subsequently cured to give the first layer 8 a sheet resistivity of 80Ω/□. The plurality of regions 10 of second material is screen printed onto the first layer 8 in such a way as to be in electrical contact therewith. The silver based ink typically has a sheet resistivity of less than 0.1Ω/□. Electrodes 12*a*, 12*b* are also provided in electrical contact with the entire length of opposing edges of the heating element 6 using a substantially conductive thermosetting ink (for example Acheson Electrodag PF410).

Optionally, a single material is used to provide both the plurality of regions 10 of second material and the electrodes 12*a*, 12*b*. In this case, the regions 10 of second material and the electrodes 12*a*, 12*b* are screen printed in a common screen printing step.

In the embodiment shown in FIG. 1, the plurality of regions 10 of the second material are applied on an outward facing surface of the first layer 8. Alternatively, the plurality of regions 10 of second material are applied to the substrate 4 prior to the first layer 8 being deposited thereon. In this case the plurality of regions 10 of second material are sandwiched between the substrate 4 and the first layer 8.

Optionally, the first layer 8 may be self-supporting, in which case the substrate 4 is omitted. Where the thermally emissive apparatus 2 is used as a thermal target to simulate the thermal signature of an object to an observer, the thermally emissive apparatus 2 is arranged in use with the plurality of regions 10 of second material on a surface of the first layer 8 facing toward said observer. Alternatively, the thermally emissive apparatus 2 is arranged in use with the plurality of regions 10 of second material on a surface of the first layer 8 facing away from said observer.

Figure 2:
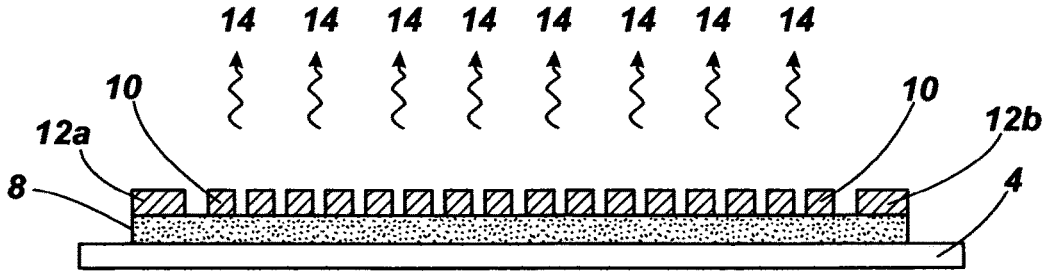
FIG. 2 shows a schematic cross sectional view of the thermally emissive apparatus of FIG. 1. The position of the cross section is denoted by the broken line in FIG. 1.

It can be seen from FIG. 2 that the discrete regions 10 of second material are arranged in spaced relationship to each other; adjacent regions 10 are not connected electrically together directly, rather regions 10 are interconnected in a network via the first layer 8 of first material.

Application of an electric current to the electrodes 12*a*, 12*b* causes Joulean heating of the resistive first layer 8, which in turn gives rise to emission of thermal infrared radiation 14 from the apparatus 2.

Figure 3:
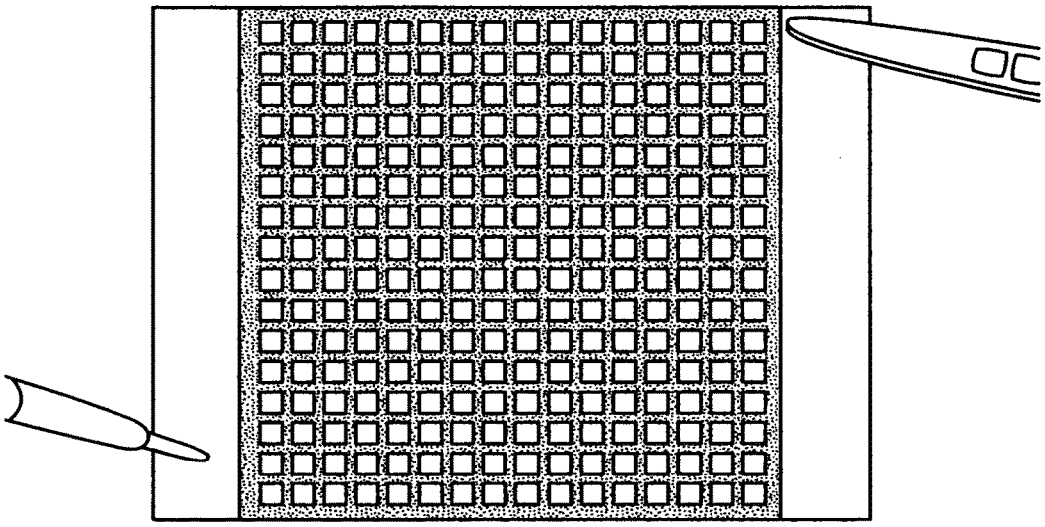
FIG. 3 shows a thermal image of a thermally emissive apparatus corresponding with the embodiment of FIG. 1.

FIG. 3 shows a thermal image of a thermally emissive apparatus 2 corresponding with the embodiment of FIG. 1. Areas of the first layer 8 interposed between regions 10 of second material are clearly seen to have an elevated temperature due to Joulean heating within the apparatus 2. The thermal image of FIG. 3 shows a view of the plurality of regions 10 of the second material on the outward facing surface of the first layer 8 and hence the differences in emissivity of the first layer and the regions of second material also has an effect on the emitted thermal infrared radiation. The plurality of regions 10 of second material are clearly discernable in the figure as areas of lower temperature than the aforementioned areas of the first layer 8 interposed there-between.

When the thermally emissive apparatus 2 is intended to be used a thermal target to simulate the thermal signature of an object, the size of the regions 10 of second material is preferably selected to be less than individually resolvable through a thermal imaging apparatus. Each region of second material within the spatial arrangement is preferably arranged within a 5 mm unit cell; unit cells being disposed at a pitch in the range 2-5 mm.

Without limitation, the regions 10 of second material are substantially rectilinear in shape. Optionally, the regions are hexagonal or circular.

As illustrated in FIG. 1, the thermo-electric heating element 6 is provided with electrodes 12*a*, 12*b* running the entire width of opposing sides thereof. This allows the electric field to be applied evenly across the entire width of the heating element to give an even heat distribution. However, this configuration requires the distance between the opposing sides of the heating element to remain constant along the entire width of the heating element, otherwise a heat gradient would occur. Accordingly, only rectangular or square shaped elements can be powered using the embodiment shown in FIG. 1.

However, for thermal target applications, circles and other complex heated profiles are required to provide realism and to accurately simulate thermal signature cues within the thermal signature of an object.

Figure 4A:
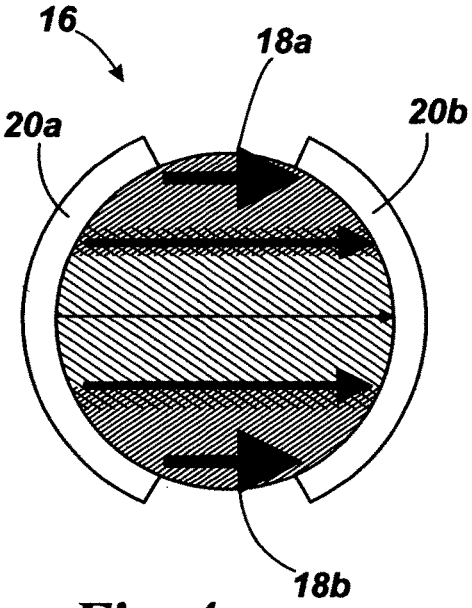
Fig. 4a (Prior Art)
FIGS. 4*a* and 4*b* show schematic views of thermally emissive apparatuses comprising circular electro-thermal heating elements. Specifically.

Referring now to FIG. 4*a*, which illustrates an example of a conventional circular electro-thermal heating element 16, current distribution within the element will be highest at 18*a* and 18*b* which presents the shortest path between electrodes, and hence lowest resistance, between opposing electrodes 20*a*, 20*b*. This gives rise to a temperature gradient across element 16 at right angles to direction of predominant current flow, with the top and bottom of the circle as shown in the figure reaching a higher temperature then the centre. Said spatial heating variations give rise to corresponding spatial variations in the intensity of infrared radiation emitted by the heating element across the surface thereof.

Figure 4B:
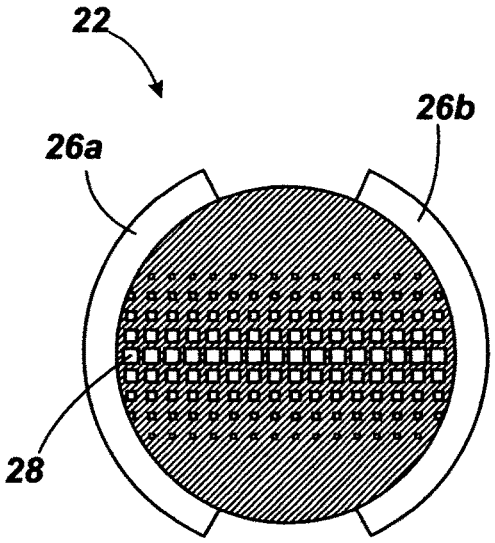

FIG. 4*b* illustrates an embodiment of the present thermally emissive apparatus which provides substantially constant heating across a circular electro-thermal heating element.

In this embodiment the spatial arrangement of the plurality of regions 10 of second material is varied over the first layer 8 of substantially electrically resistive material so as to provide a tailored current distribution within said layer 8 over the entire circle area. An even heat distribution can thus be achieved across the surface of the circle, which in turn ensures that the intensity of thermal infrared radiation 14 emitted by the heating element is substantially constant across the surface of the circle.

Specifically, the density of regions 10 of second material is varied spatially across the surface of the first layer 8. In this manner the percentage area coverage of said second material varies spatially across the surface of the first layer 8. In particular, the spatial density of regions 10 of second material is arranged to be high along the longest path between electrodes 26*a*, 26*b* in the circular heating element 22 (centre horizontal line in FIG. 4*b*) referred to hence forth as the chord line 28. These regions 10 of second material and the electrical contacts with the first layer 8 of first material cooperate to reduce the effective sheet resistivity of the first layer along the chord line 28 of the circle to below that of the first material. The resistance of said first layer 8 is reduced in this direction and the current density is correspondingly increased. Consequently, the electro-thermal heating in this direction is increased, giving rise to infrared radiation having a higher intensity than in the prior art apparatus of FIG. 4*a*.

The density of regions 10 of second material reduces in directions substantially perpendicular to the chord line. In other words, the percentage area coverage of said second material reduces in said directions. Specifically, the density tapers (reducing) with distance from the abovementioned diameter of the circle.

As mentioned previously, the spatial arrangement of the plurality of regions of second material relates to the size of said regions (the dimensions and hence the area thereof), the shape of the regions, and the magnitude of the spaces between said discrete regions.

This technique of varying the density of regions 10 of second material spatially across the surface of the first layer 8 is not limited to circles, but is applicable to other complex, non-rectangular heating elements.

Alternative to providing substantially constant heating of elements having complex shapes, the technique of varying the spatial arrangement of the plurality of regions 10 of second material over the first layer 8 of substantially electrically resistive material can be used to deliberately induce temperature variations and gradients spatially across an electro-thermal heating element.

Specifically, the spatial arrangement of the regions 10 of second material can be varied across the first layer 8 of substantially electrically resistive material to deliberately vary the current distribution within said layer 8 over an area of an electro-thermal heating element. The spatial arrangement can be designed so as to increase current density in specific areas of the heating element so that said areas will be achieve higher temperatures than other areas. Variations in heat distribution can thus be achieved across the surface of the heating element, which in turn means that spatial variations in the intensity of thermal infrared radiation emitted by the heating element can be achieved. Thus, heated profiles can be created within the area of a single electro-thermal heating element.

A further embodiment of the invention relates to a thermally emissive apparatus for use as a thermal infrared target to simulate a thermal signature of an object.

In one embodiment of the present invention, a thermal infrared target comprises a thermally emissive apparatus having a plurality of thermo-electric heating elements. In this case the thermally emissive apparatus comprises a first layer 30 of a first substantially resistive material as shown in FIG. 5.

Figure 5:
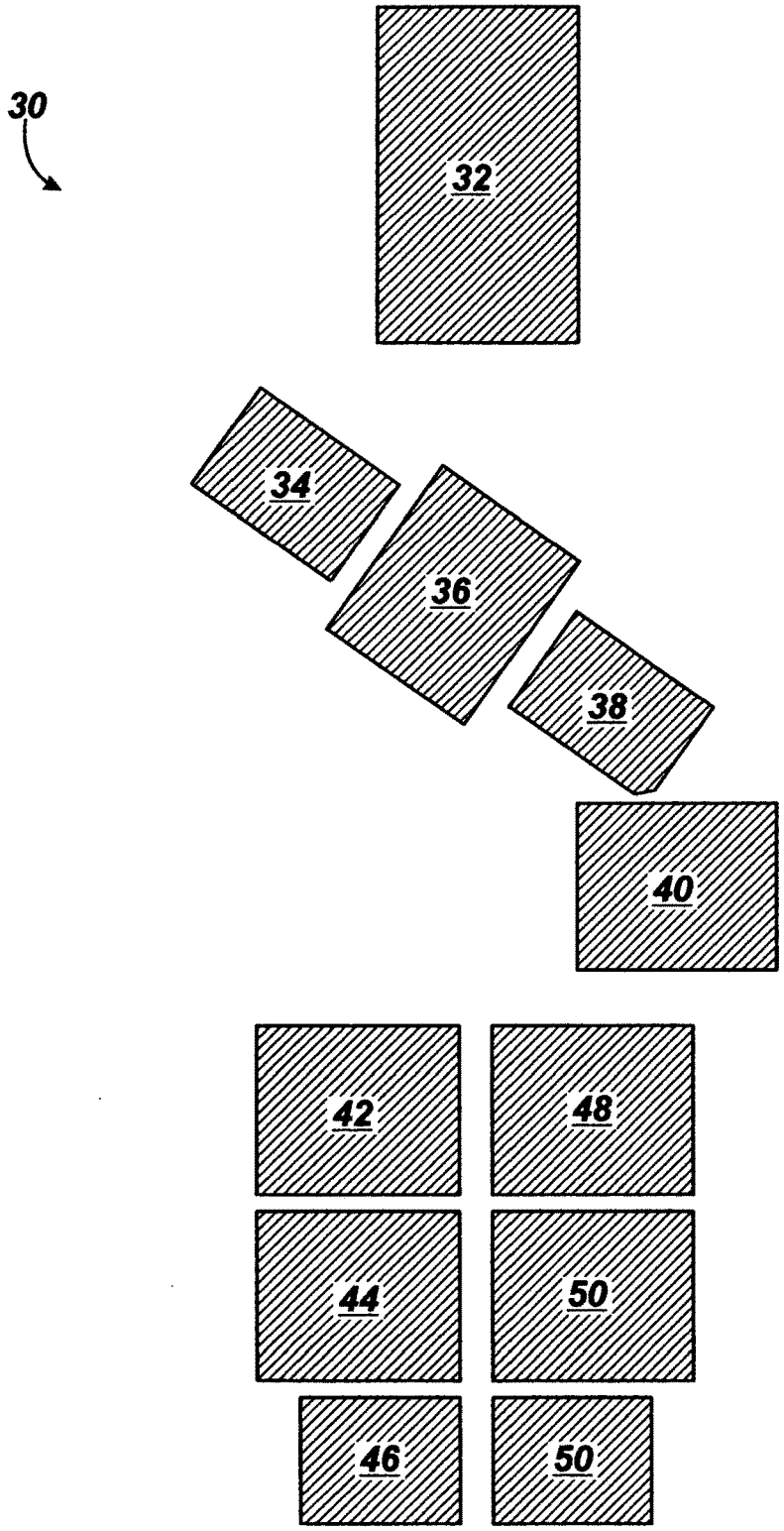
FIG. 5 shows a schematic view of a first layer of first material within a thermal target according to one embodiment of the present invention.

Referring now to FIG. 5, the first layer 30 comprises a plurality of areas of said first substantially resistive material, each area corresponding with a different heating element within the apparatus. In this embodiment, the thermal target depicts a human figure carrying an item diagonally across the upper body. By way of further explanation, parts of the figure's body are simulated by the following respective areas of first material; area 32 corresponds with the figure's head, areas 36 and 40 correspond with the figure's hands and areas 42-52 correspond with the figure's legs. Areas 34 and 38 correspond with the carried item.

The first layer 30 comprises a single layer of a substantially homogeneous first material. In common with the embodiment of FIG. 1, the first material comprises a carbon based thermoplastic ink (for example, Nicomatic NCC-500C) screen printed onto a substrate (not shown in the figure). Without limitation, the substrate comprises a polymer film or paper.

Figure 6:
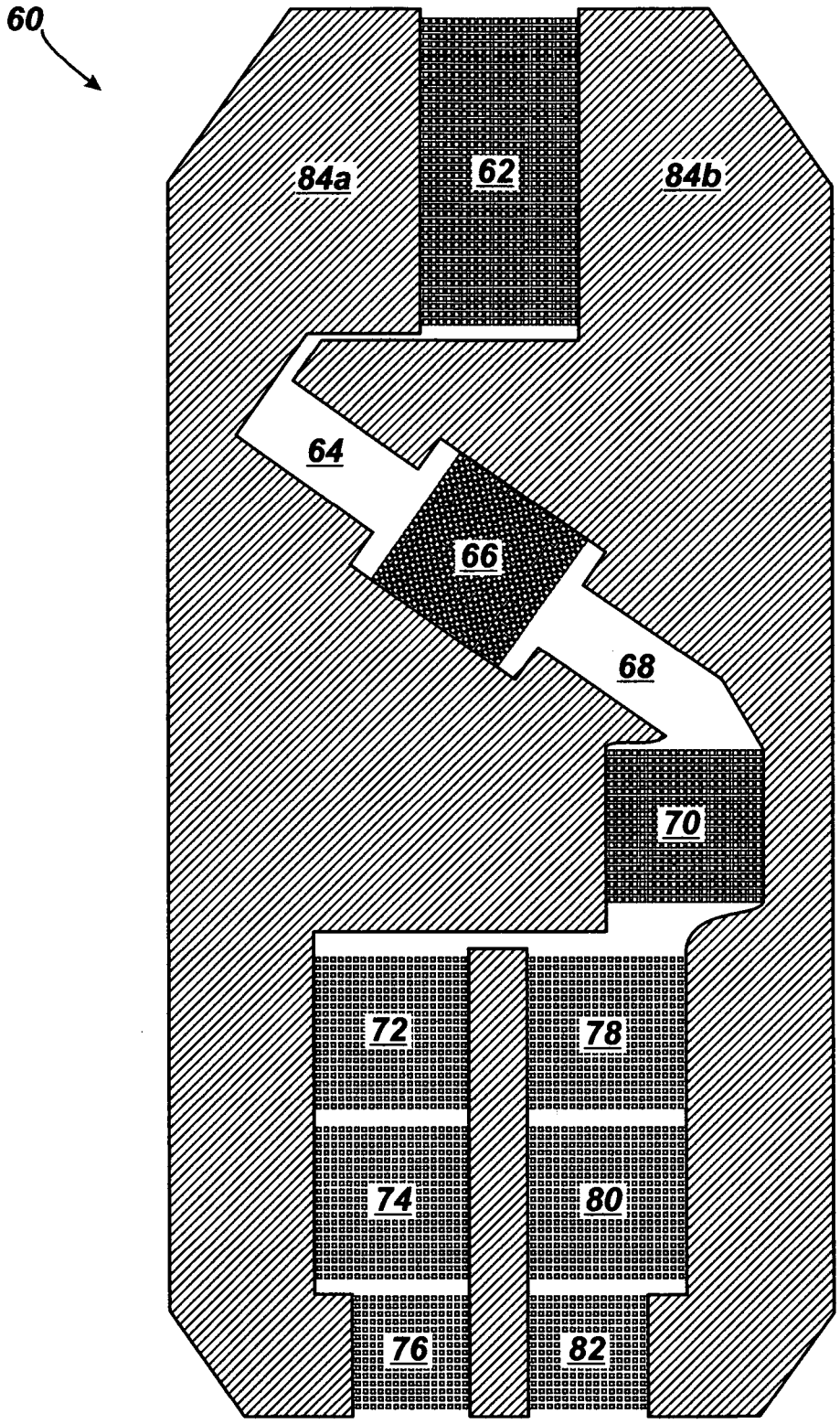
FIG. 6 shows a schematic view of a second layer of second material within a thermal target according to one embodiment of the present invention.

The thermally emissive apparatus also comprises a second layer 60 of a second substantially conductive material as shown in FIG. 6.

Referring now to FIG. 6, the second layer 60 comprises a plurality of areas of said second substantially conductive material, each area corresponding with a different heating element within the apparatus. By way of further explanation, parts of the figure's body correspond the following respective areas of second material; area 62 corresponds with the figure's head, areas 66 and 70 correspond with the figure's hands and areas 72-82 correspond with the figure's legs. The second material is omitted from areas 64 and 68.

The second layer 60 comprises a single layer of a substantially homogeneous second material. In common with the embodiment of FIG. 1, the second material comprises a silver based ink (for example, Acheson Electrodag PF410) screen printed onto the first layer 30 and the substrate in such a way as to be in electrical contact with the first layer 30.

Electrodes 84*a*, 84*b* are also provided in electrical contact with opposing edges of the plurality of heating elements using a substantially conductive ink (for example, Acheson Electrodag PF410).

Heating elements within the thermal target are arranged to emit thermal infrared radiation having different intensities in order to accurately simulate thermal signature cues corresponding with different parts of the figure's body. For example, portions of the target corresponding with the figure's head and hands are arranged in use to be hotter than other parts and hence shall emit thermal infrared radiation having a higher intensity than said other parts.

Each of the areas 62, 66, 70-82 within the second layer comprise a plurality of regions 10 of second material arranged to control the effective sheet resistivity (and hence resistance) of a corresponding area of first material in the first layer 8. The spatial arrangement of the plurality of regions 10 of second material is selected within each of said areas 62, 66, 70-82 to provide a predetermined current density and hence to provide emission of thermal infrared radiation having a predetermined intensity.

The spatial arrangement of regions of second material 10 differs between some of the heating elements such that the heating elements emit thermal infrared radiation having different intensities.

Figure 7:
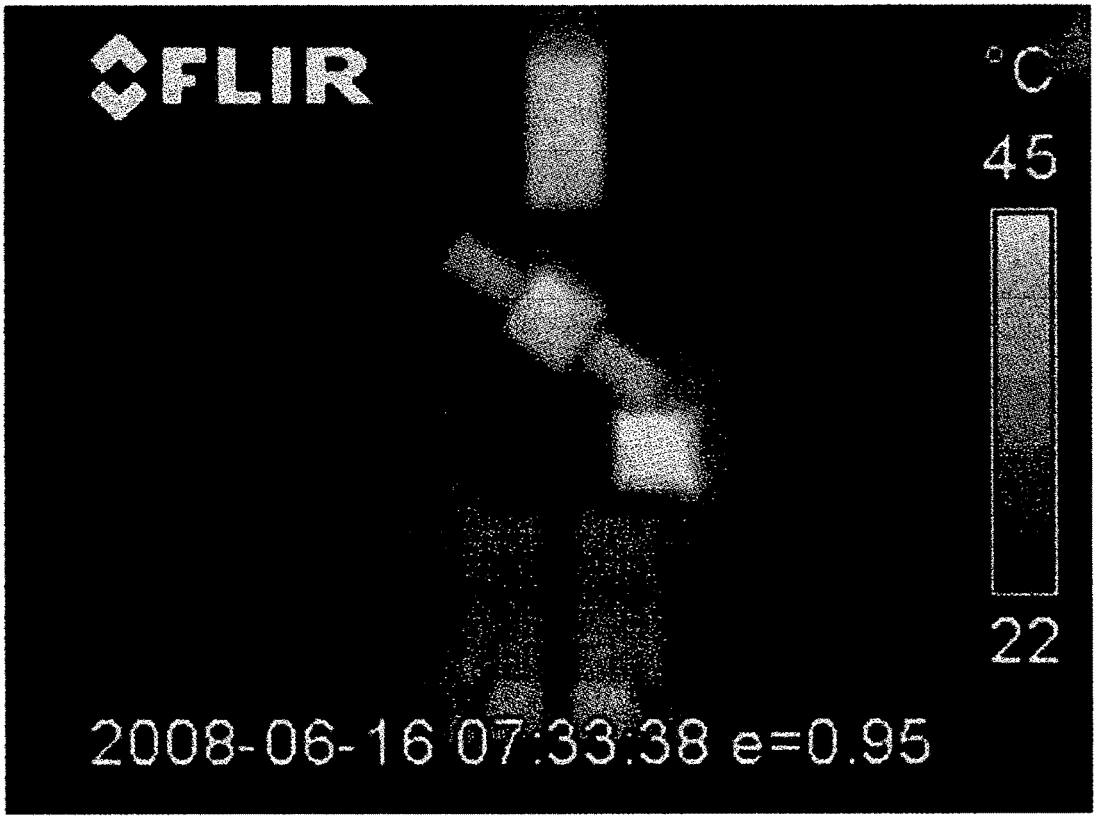
FIG. 7 shows a thermal image of a thermal target comprising the material layers of FIGS. 5 and 6.

For example, heating elements corresponding with hotter parts of the figure's body (i.e. head and hands) have a spatial arrangement having a high density of regions of second material 10. The percentage area coverage of said second is thus arranged to be high within said heating elements. This gives rise to a lower average effective sheet resistivity within said heating elements leading to a higher current density and hence a higher average temperature as can be seen in the thermal image in FIG. 7. By comparison, cooler parts of the figure's body (i.e. the legs) have a spatial arrangement having a lower density of regions of second material 10. The percentage area coverage of said second is thus arranged to be lower within said heating elements. This gives rise to a higher average effective sheet resistivity within said heating elements leading to a lower current density and hence a lower average temperature as can be seen in the thermal image in FIG. 7.

In the foregoing embodiments the first and second materials have been described in terms of thermoplastic inks with the apparatus being fabricated by screen printing, however said first and second materials may comprise any material capable of being applied to the apparatus by a suitable deposition method. Without limitation, the apparatus may be fabricated by inkjet printing, flexographic printing, gravure printing, pad printing or any other suitable method.

In view of the foregoing description it will be evident to a person skilled in the art that various modifications may be made within the scope of the invention.

The scope of the present disclosure includes any novel feature or combination of features disclosed therein either explicitly or implicitly or any generalisation thereof irrespective of whether or not it relates to the claimed invention or mitigates any or all of the problems addressed by the present invention. The applicant hereby gives notice that new claims may be formulated to such features during the prosecution of this application or of any such further application derived there-from. In particular, with reference to the appended claims, features from dependent claims may be combined with those of the independent claims and features from respective independent claims may be combined in any appropriate manner and not merely in the specific combinations enumerated in the claims.

The invention claimed is:

1. A thermally emissive apparatus comprising:

an electro-thermal heating element comprising a first layer of a first material having a first sheet resistivity and a second layer comprising a plurality of discrete regions of a second material having a second sheet resistivity lower than that of the first material, the discrete regions of second material being arranged in a spaced relationship to one another within a spatial arrangement and being distributed over an upper surface of the first layer in electrical contact with the first layer such that the discrete regions of second material are electrically connected with each other via the first layer; and a pair of electrodes for applying a potential difference across the first layer of the heating element to cause an electric current to flow therethrough between the electrodes in use;

wherein area coverage of the first layer of the heating element by the respective discrete regions of second material varies over the upper surface of the first layer such that the effective sheet resistivity of the heating element varies spatially based on overlap between said first material and said second material, providing that when an electric current flows between the electrodes in use the extent of Joulean heating of the heating element varies spatially and a corresponding manner to the effective sheet resistivity of the first layer;

wherein the spatial arrangement of the regions of second material within the heating element is non-uniform over the upper surface of the first layer and wherein at least one of size and shape of the regions of second material varies in at least one direction such that the effective sheet resistivity of the first layer varies spatially in relation to the spatial arrangement of the regions of second material.

2. A thermally emissive apparatus according to claim 1 wherein the spatial variation in effective sheet resistivity of the first layer is arranged so as to provide a substantially uniform current density within the first layer in use.

3. A thermally emissive apparatus according to claim 1 wherein the spatial variation in effective sheet resistivity of the first layer is arranged so as to provide substantially uniform Joulean heating of the heating element during use.

4. A thermally emissive apparatus according to claim 1 arranged in use to emit infrared radiation having an intensity which is substantially uniform spatially over a surface of the heating element.

5. A thermally emissive apparatus according to claim 1 arranged in use to emit infrared radiation having an intensity which varies spatially over a surface of the heating element in relation to the spatial arrangement of the regions of second material.

6. A thermally emissive apparatus according to claim 1 having a plurality of electro-thermal heating elements arranged spatially on a surface thereof, wherein the first layer of first material is common to each of said plurality of heating elements.

7. A thermally emissive apparatus according to claim 6 wherein the plurality of heating elements have at least one common electrical connection.

8. A thermally emissive apparatus according to claim 6, wherein the plurality of regions of second material have a spatial arrangement which cooperates with the first layer so as to impart a predetermined effective sheet resistivity to the first layer in the vicinity of said spatial arrangement and wherein the spatial arrangement of the regions of second material is the same within said plurality of heating elements.

9. A thermally emissive apparatus according to claim 6, wherein the plurality of regions of second material have a spatial arrangement which cooperates with the first layer so as to impart a predetermined effective sheet resistivity to the first layer in the vicinity of said spatial arrangement and wherein the spatial arrangement of the regions of second material within a first heating element is different to that within a second heating element.

10. A thermally emissive apparatus according to claim 9 arranged in use to emit infrared radiation having a first intensity from the first heating element and to emit infrared radiation having a second intensity from the second heating element.

11. A thermally emissive apparatus according to claim 1 wherein the thermal emissivity of the regions of second material cooperates with the effective sheet resistivity of the first layer so as to vary the intensity of infrared radiation emitted by the thermally emissive apparatus.

12. A thermally emissive apparatus according to claim 1 adapted in use to emit infrared radiation having a wavelength in the range of 1 μm-100 μm.

13. A thermally emissive apparatus according to claim 1 arranged as a thermal target to simulate the thermal signature of an object.

14. A thermally emissive apparatus according to claim 1 arranged as an electro-thermal ice protection device to provide ice protection of an aerodynamic surface.

15. A thermally emissive apparatus according to claim 1 that emits infrared radiation having a wavelength in the range of 3 μm to 14 μm.

* * * * *